US007294037B2

(12) United States Patent
Hayashi

(10) Patent No.: US 7,294,037 B2
(45) Date of Patent: Nov. 13, 2007

(54) REMOTE-CONTROL TOY AND FIELD FOR THE SAME

(75) Inventor: Ryoji Hayashi, Tokyo (JP)

(73) Assignee: Konami Corporation, Tokyo (JP)

( * ) Notice: Subject to any disclaimer, the term of this patent is extended or adjusted under 35 U.S.C. 154(b) by 67 days.

(21) Appl. No.: 10/542,874

(22) PCT Filed: Jan. 16, 2004

(86) PCT No.: PCT/JP2004/000279

§ 371 (c)(1),
(2), (4) Date: Nov. 4, 2005

(87) PCT Pub. No.: WO2004/064958

PCT Pub. Date: Aug. 5, 2004

(65) Prior Publication Data

US 2006/0111014 A1 May 25, 2006

(30) Foreign Application Priority Data

Jan. 17, 2003 (JP) ..... 2003-010463

(51) Int. Cl.
*A63H 30/04* (2006.01)

(52) U.S. Cl. ..... 446/454; 446/465

(58) Field of Classification Search ..... 446/454, 446/455, 456, 457, 460, 465, 468, 484
See application file for complete search history.

(56) References Cited

FOREIGN PATENT DOCUMENTS

| | | | |
|---|---|---|---|
| JP | S59-44496 | U | 3/1984 |
| JP | H3-36695 | U | 4/1991 |
| JP | 3-159674 | A | 7/1991 |
| JP | 9-44246 | A | 2/1997 |

OTHER PUBLICATIONS

Patent Abstracts of Japan for JP9-44246 published on Feb. 14, 1997.
Patent Abstracts of Japan for JP3-159674 published on Jul. 9, 1991.
English translation of Abstract of JP-A-S59-44496 published on Mar. 23, 1984.
English translation of Abstract of JP-A-H3-36695 published on Apr. 10, 1991.
International Search Report for PCT/JP2004/000279 mailed Feb. 24, 2004.

*Primary Examiner*—Kien Nguyen
(74) *Attorney, Agent, or Firm*—Darby & Darby P.C.

(57) ABSTRACT

A remote-control toy is provided that includes: a controller (2) that transmits a control signal according to an operation by a user; a movable body that is controlled to drive based on the control signal from the controller; and a field in which the movable body can move. The movable body includes a detecting unit that reacts to a predetermined object to be detected and outputs a detection signal, and a processing unit that performs predetermined processing in response to the output of the detection signal. The object to be detected can be placed in the field in such a manner that the position of the object to be detected can be changed.

7 Claims, 11 Drawing Sheets

REMOTE-CONTROL TOY AND FIELD FOR THE SAME

CROSS-REFERENCE TO PRIOR APPLICATION

This is a U.S. national phase application under 35 U.S.C. §371 of International Patent Application No. PCT/JP2004/000279 filed Jan. 16, 2004, and claims the benefit of Japanese Patent Application No. 2003-010463 filed Jan. 17, 2003 which is incorporated by reference herein. The International Application published in Japanese on Aug. 5, 2004 as WO 2004/064958 A1 under PCT Article 21(2).

TECHNICAL FIELD

The present invention relates to a remote-control toy that transmits a control signal from a controller to a movable body, thereby controlling the movable body.

BACKGROUND ART

There have been games in which movable bodies such as combat vehicles of remote-control toys battle against each other in firing gun, for example.

In such conventional battle games, however, the outcome of each game is decided only by interactions between the movable bodies (such as the magnitude of damage caused by each attack). Therefore, the play contents such as the way of playing, the game procedures and so on are limited. Because of this, the game is likely to become monotonous, and users get bored with it soon. Also, to enjoy the thrill of attacks to be made on a movable body, it is always necessary for the user to have an opponent, because such a thrill cannot be felt when there is only one player.

DISCLOSURE OF INVENTION

Therefore, the object of the present invention is to provide a remote-control toy that gives a wider variety of play contents and provides more excitement through a means to affect the movable bodies in addition to the interactions of the movable bodies.

The above described problems are eliminated by a remote-control toy that includes: a controller that transmits a control signal according to an operation by a user; a movable body that is controlled to drive based on the control signal from the controller; and a field in which the movable body can move. In this remote-control toy, the movable body includes a detecting unit that reacts to a predetermined object to be detected and outputs a detection signal, and a processing unit that performs predetermined processing in response to the output of the detection signal. The object to be detected is placed in the field in such a manner that the position of the object to be detected can be arbitrarily changed.

According to the present invention, when a remotely controlled movable body detects an object to be detected in a field, the movable body performs a predetermined operation such as a vibrating operation. In this manner, the movable body is affected not only by another movable body but also by the field. When the object to be detected can cause damage to the movable body, a user can enjoy the remote control on the field with a thrilling feeling because the user tries to avoid the object to be detected. When the object to be detected adds to the score, a user can enjoy the remote control on the field with an expecting feeling because the user tries to detect the object to be detected. Further, the position of the object to be detected can be arbitrarily changed. Thus, monotonousness caused by repeating the same situation can be avoided.

The predetermined object to be detected may be a magnet, and the field may have a plurality of placement portions in which the predetermined object to be detected can be embedded.

Thus, a magnet as an object to be detected is simply embedded in a desired one of the placement portions. If the object to be detected is to change positions, the object to be detected is simply moved into another one of the places to embed the object to be detected.

The field may have a mat and a cover that cloaks the surface of the mat, and the placement portions may be concave portions that are open through the surface of the mat.

Thus, the cover can hide the entire surface, even if a magnet is embedded in a concave portion formed in the surface. Accordingly, a user cannot visually recognize the existence of the embedded magnet.

A protruding member protruding from the surface of the mat may be provided on the surface of the mat in such a manner that the position of the protruding member can be arbitrarily changed. The protruding member can also be cloaked by the cover.

By covering the protruding portion of the protruding member protruding from the surface of the mat, a convex portion is made, which has the end top of the protruding portion as a peak of the convex portion. By combining the convex portion and flat portions, an undulating landform can be formed on the field. Thus, variable movements of the movable body can be enjoyed.

The predetermined object to be detected may be attached to the top end of the protruding member. With this arrangement, a field in which a convex portion is not necessarily free of an object to be detected can be formed.

The field may have a joining portion to be joined to another field. With this arrangement, the size and the shape of a field can be selected according to the occasion and the location. Also, a field can be formed as the territory of a user. In this manner, a battle game can be enjoyed, with the field of the user being joined to the field of the opponent.

The above described problems are also eliminated by a field in which a movable body can move, with the movable body being controlled to drive based on a control signal transmitted from a controller according to an operation by a user. The movable body includes a detecting unit that reacts to a predetermined object to be detected and outputs a detection signal, and a processing unit that performs predetermined processing in response to the output of the detection signal. The object to be detected is placed in the field in such a manner that the position of the object to be detected can be arbitrarily changed. Using this field, the remote-control toy can be realized.

BEST MODE FOR CARRYING OUT THE INVENTION

Figure 1:
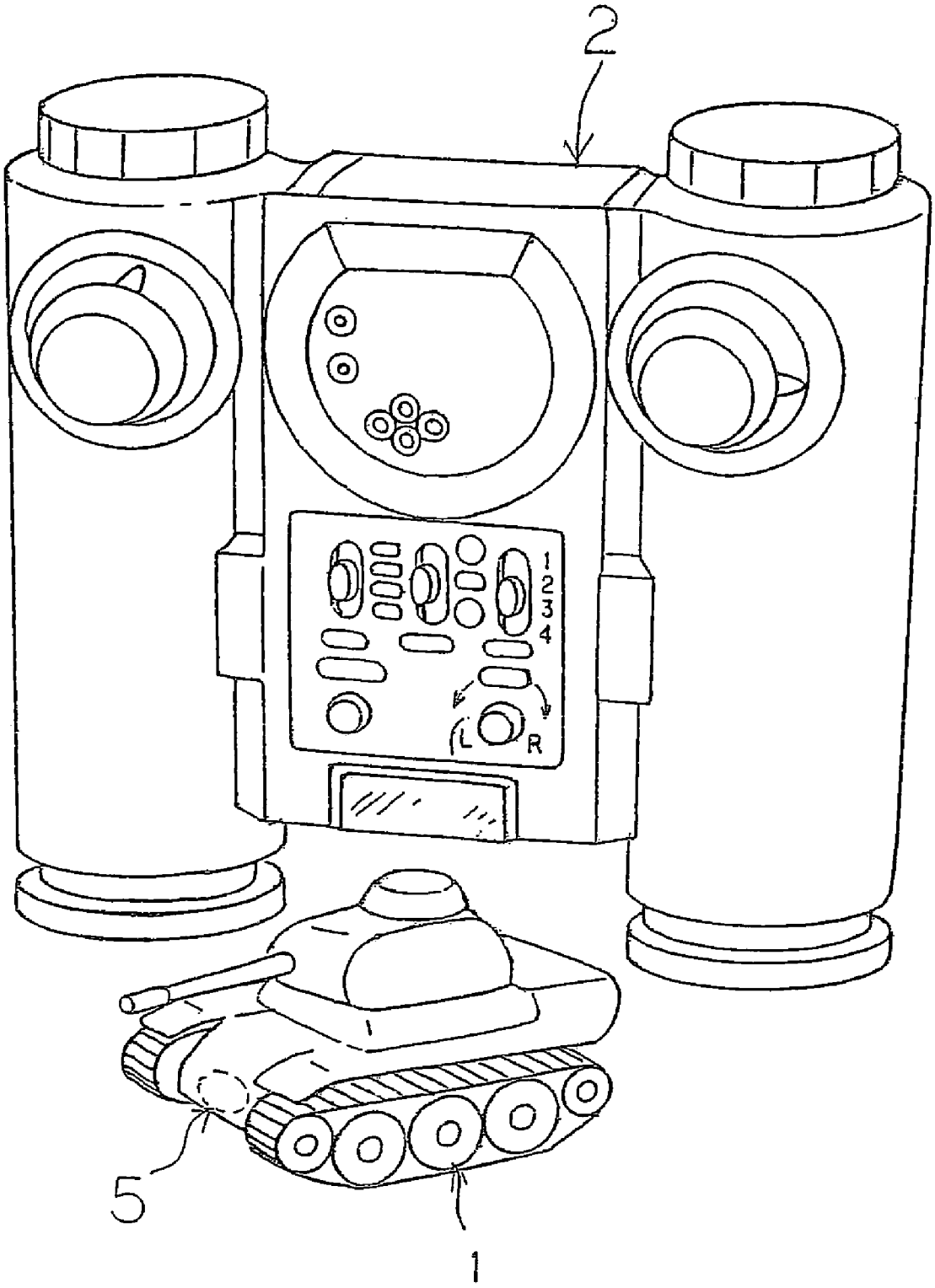
FIG. 1 shows a controller and a movable body in this embodiment of the present invention.
Figure 2A:
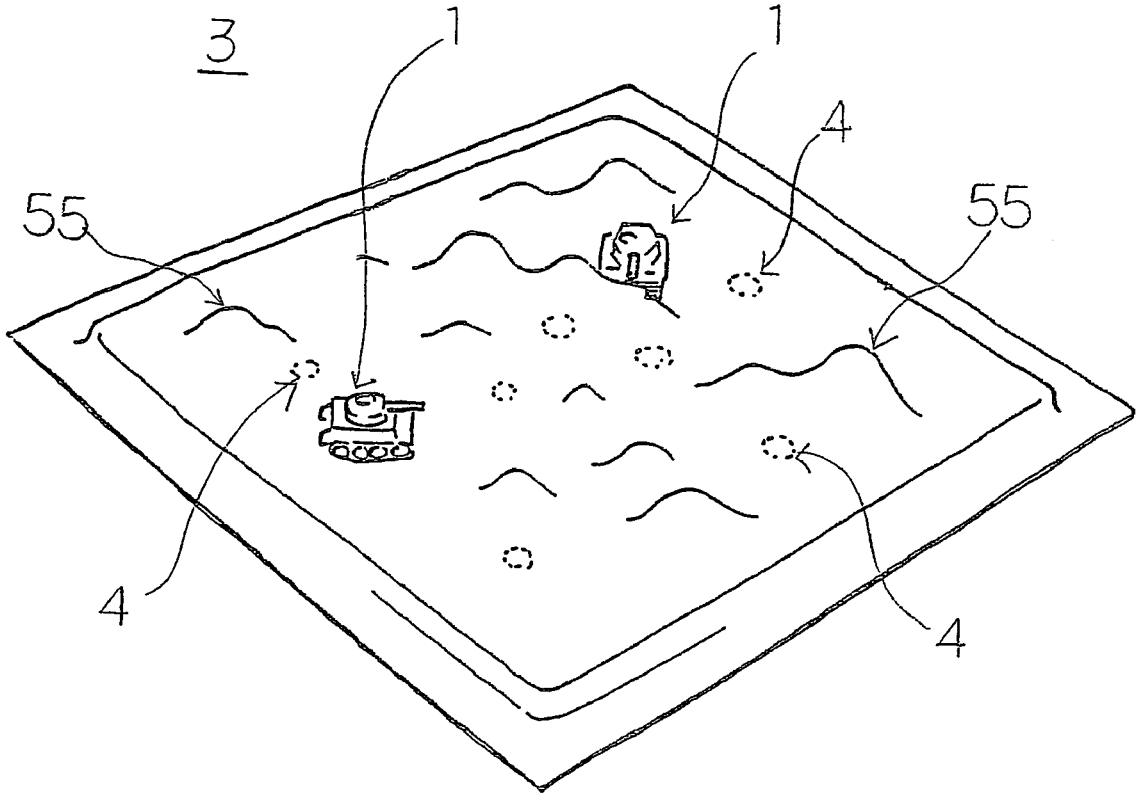
FIG. 2A shows the exterior of a field of this embodiment.

FIGS. 1 and 2A show an embodiment of the present invention. A combat vehicle model 1 as a movable body is remotely controlled with drive information contained in a control signal transmitted from a controller 2. The combat vehicle model 1 can move in a field 3. The means of any kind for remote-controlling the combat vehicle model 1 may be employed. For example, infrared rays, electric waves, or radio frequency may be employed. In this embodiment, two or more combat vehicles 1 can be remotely controlled at once, and can attack one another in a game. The field 3 has undulations 55 and magnets 4 as predetermined objects to be detected. Each combat vehicle model 1 has a magnetic line sensor 5 as the means of detecting the magnets 4. As shown in FIG. 1, the magnetic line sensor 5 is preferably located at a lower portion of the combat vehicle model 1, so as to facilitate the detection of the magnets 4. The structure of the field 3 and the method of placing the magnets 4 will be described later in detail.

Figure 2B:
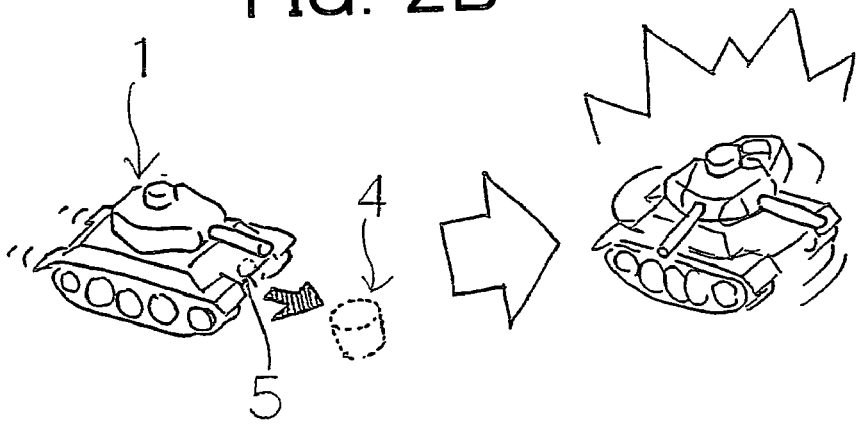
FIG. 2B shows the damage control to be performed when the movable body reacts to an object to be detected.

When the magnetic line sensor 5 detects one of the magnets 4, the combat vehicle model 1 performs a damage control operation by rotating the vehicle body or the turret on the spot, as shown in FIG. 2B. During the damage control, remote control from the controller 2 is inable. In this embodiment, the damage control lasts approximately five seconds, but the duration of the damage control is not limited to that. Also, the contents of the damage control are not limited to the above operations, but combinations of light emission from the combat vehicle model 1, a change in vehicle body color, and vibration of the vehicle body may be employed. With the above structure, a battle game can be played, with the magnets 4 being regarded as landmines. Hereinafter, the operation to be performed for damage control when the combat vehicle model 1 detects a magnet 4 will be referred to as the damage control operation.

Figure 3:
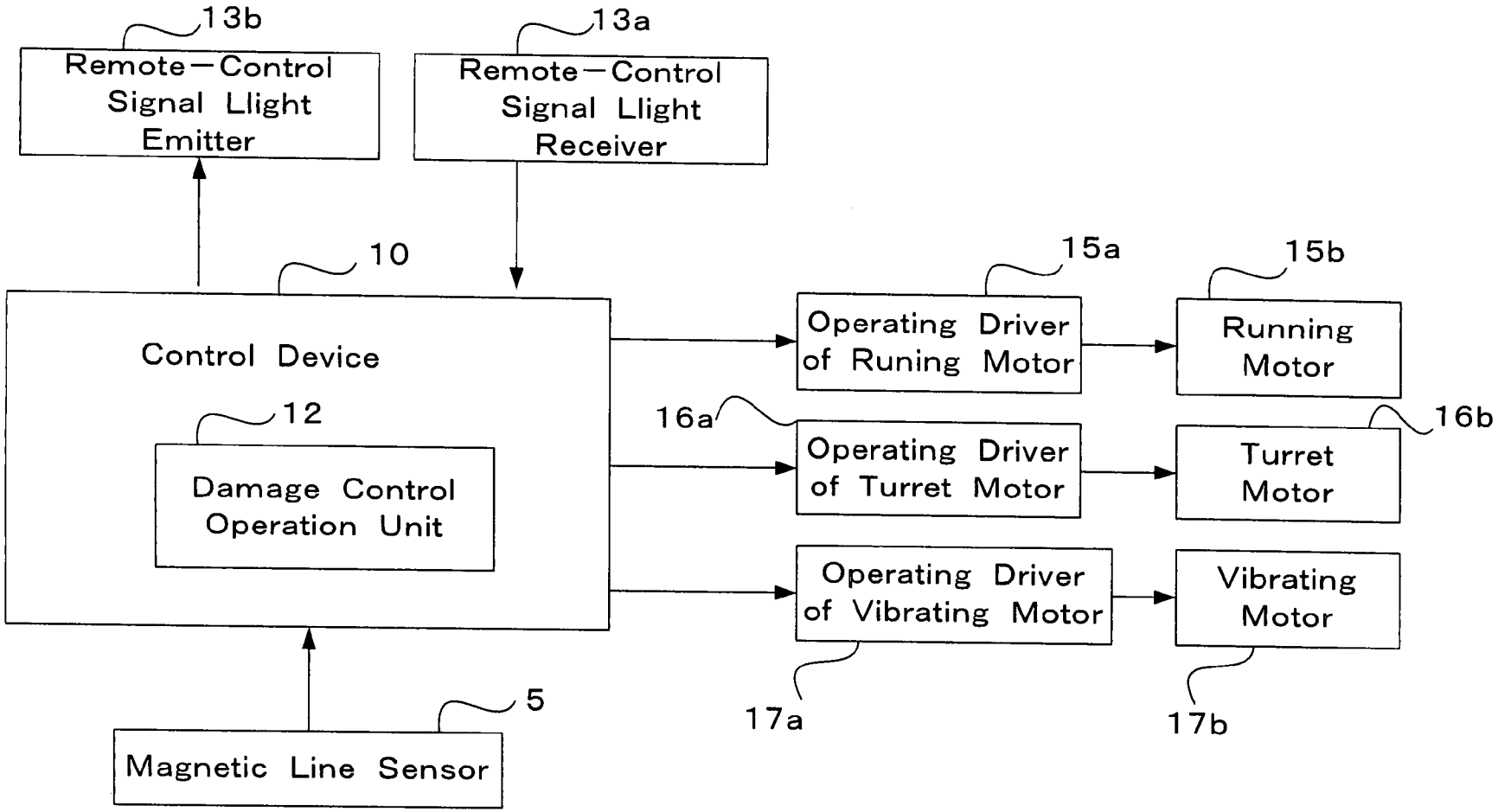
FIG. 3 is a functional block diagram of the movable body.

FIG. 3 is a functional block diagram of the combat vehicle model 1. The combat vehicle model 1 includes a control device 10 as a processing unit that performs operations including the damage control operation. This control device 10 is formed as a computer that includes a CPU and various peripheral circuits such as a RAM and a ROM that are required for the operations of the CPU. Especially, the control device 10 includes a damage control operation unit 12 that performs predetermined damage control.

In addition to the magnetic line sensor 5, the control device 10 is connected to a remote-control signal light receiver 13*a* that receives the control signal or the like transmitted from the controller 2, a remote-control signal light emitter 13*b* that transmits signals such as firing information from the combat vehicle model 1, and operating motor drivers 15*a*, 16*a*, and 17*a* for driving operating motors 15*b*, 16*b*, and 17*b*. As the operating motors, the running motor 15*b* that generates running operations, the turret motor 16*b* that causes the turret to revolve, and the vibrating motor 17*b* that causes the vehicle body to vibrate, are provided. However, motors to be employed here are not limited to the above.

The remote-control signal light receiver 13*a* receives the light of a firing signal that is transmitted as firing from the remote-control signal light emitter 13*b* of another combat vehicle model 1. Upon receipt of the firing signal, the remote-control signal light receiver 13*a* sends the signal to the damage control operation unit 12 of the control device 10. Based on the signal, the damage control operation 12 determines the power of the gun fire or the like, and the damage control operation caused by the gun fire is performed. For example, a damage control instruction suitable for the situation of the gun fire is generated for each of the operating motor drivers 15*a*, 16*a*, and 17*a*, and is then output. According to the output damage control instruction, the operating motor drivers 15*a*, 16*a*, and 17*a* drive the respective operating motors 15*b*, 16*b*, and 17*b*.

When sensing magnetic lines with a density of a predetermined value or higher, it is determined that a magnet 4 has been detected and the magnetic line sensor 5 outputs a detection signal to the control device 10. In this embodiment, a Hall IC is employed as a sensor device constituting the magnetic line sensor 5. Since magnets exhibit various characteristics depending on materials, shapes, and methods of magnetizing, a sensor that is suitable for the characteristics of magnets to be used is employed as the magnetic line sensor 5.

when the detection signal that is output from the magnetic line sensor 5 is input to the control device 10, the detection signal is output to the damage control operation unit 12. A damage control instruction suitable for the case where a magnet 4 is detected as a landmine is output from the damage control operation unit 12 to each of the operating motor drivers 15*a*, 16*a*, and 17*a*. According to the damage control instruction, the respective motors 15*b*, 16*b*, and 17*b* perform damage control. Further, by the damage control instruction from the damage control operation unit 12, the control device 10 ignores the control signal from the controller 2 that has been received by the remote-control signal light receiver 13*a*. Even if the control signal is directed to the subject combat vehicle model 1, the drive information is not output to the operating motor drivers 15*a*, 16*a*, and 17*a*. Alternatively, a signal that causes crosstalk with the control signal containing the drive information to the subject model 1 from the controller 2 may be generated.

Figure 11:
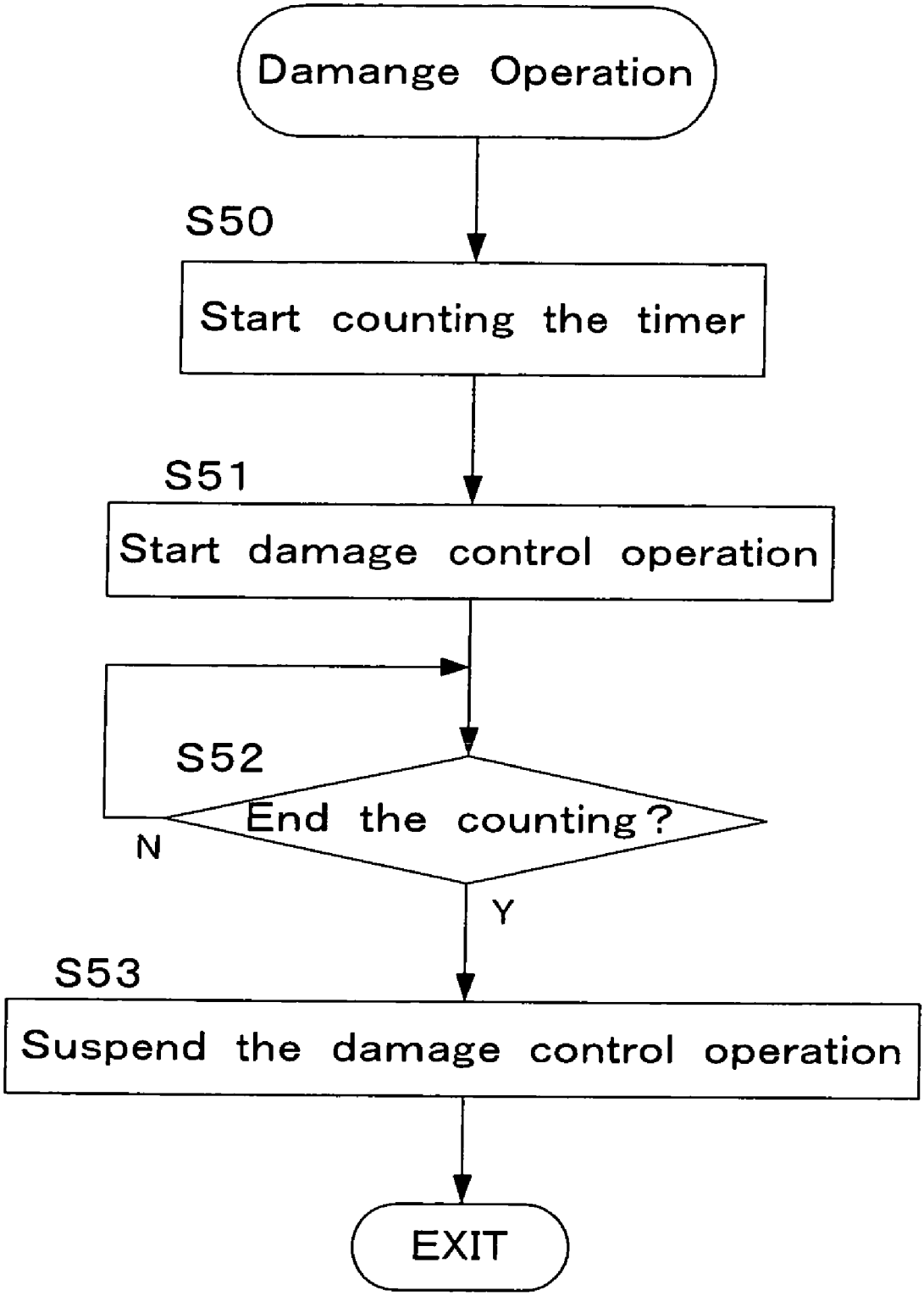
FIG. 11 is a flowchart of the operation to be performed by the control device of a movable body when the movable body detects an object to be detected.

Referring now to the flowchart of FIG. 11, the flow of the damage operation to be performed by the control device 10 after the combat vehicle model 1 detects a magnet 4 is described. Upon receipt of a signal from the magnetic line sensor 5 that notifies a magnet 4 has been detected, the control device 10 starts counting the timer (step S50). This timer measures the time for performing damage control. In this embodiment, the duration of damage control is set to be five seconds, as described above. When the counting of the timer starts, an instruction to perform the damage control operation is issued (step S51). The damage control operation includes the operation of physically driving the combat vehicle model 1, and the operation of nullifying the drive information from the controller 2. Whether the counting of the timer has been ended is determined (step S52). When it is determined that the counting of the timer has not been ended, the damage control operation is continued. When it is determined that the counting of the timer has been ended, that is, five seconds have passed, the damage control operation is suspended (step S53), and the control device 10 returns to the regular operation.

Figure 4:
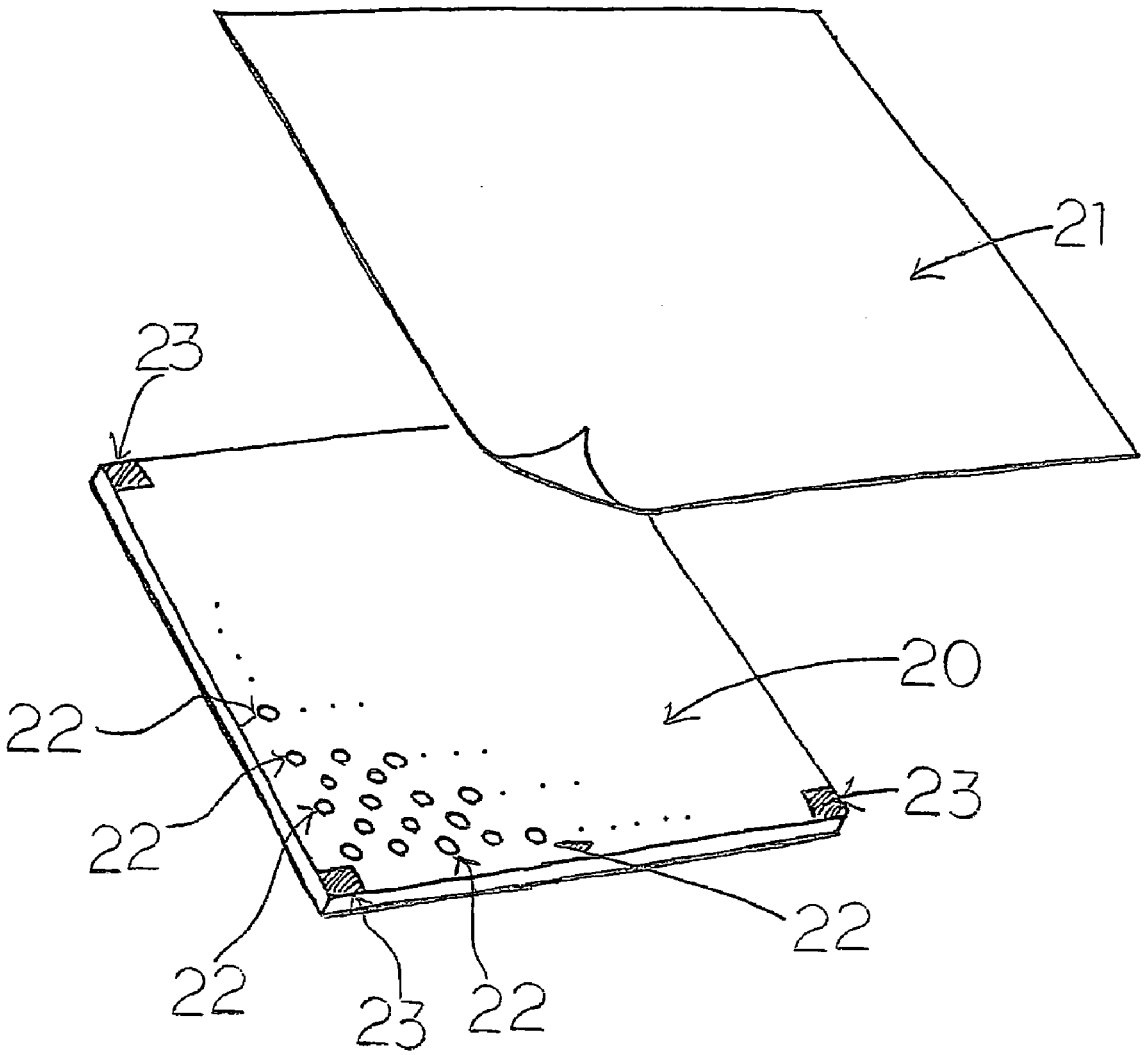
FIG. 4 shows the structure of the field.

Next, the structure of the field 3 is described. As shown in FIG. 4, the field 3 includes a rectangular mat 20 and a field cloth 21 to cover the mat 20.

The field cloth 21 is preferably a soft, thick cloth that can transmit the magnetic paths of the magnetic lines from the magnets 4. Although the field cloth 21 has a square shape in this embodiment, it can be of any size and shape, as long as it can cloak the entire surface of the mat 20.

The mat 20 has a square surface in this embodiment, and is made of a urethane of such a thickness as to embed the magnets 4. The shape of the surface is not limited to the square shape, though. On the surface of the mat 20, holes 22 as the placement portions for embedding the magnets 4 are formed. Velcro (registered trade mark) straps 23 on the four corners of the mat 20 are provided to prevent the field cloth 21 from moving.

Next, the holes 22 in the mat 20, the magnets 4 embedded at the holes 22, and plastic sticks 25 and magnet-attached plastic sticks 26 are described. The plastic sticks 25 and the magnet-attached plastic sticks 26 are protruding members that are used to form the undulations 55.

Figure 5A:
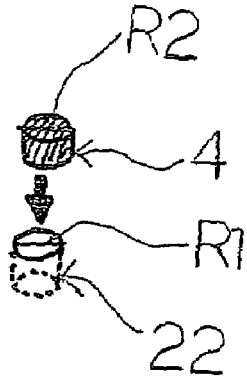
FIG. 5A shows a magnet and a hole in which the magnet is to be embedded.

As shown in FIG. 5A, each magnet 4 has a cylindrical shape, and each hole 22 is a cylindrical hole to accommodate the magnet 4. So as to steady the magnet 4 embedded in the hole 22, the diameter R1 of the hole 22 should preferably be the same as the diameter R2 of the magnet 4. The magnet 4 is a permanent magnet, and is embedded in the hole 22, with the side to react to the magnetic line sensor 5 facing upward. The depth of each hole 22 is approximately the same as the thickness of each magnet 4. Only a single magnet 4 may be enough in a game, but more excitement of playing can be realized by two or more magnets 4. Also, the shape of the magnet 4 and the shape of the hole 22 are not limited to the above described shapes.

Figure 5B:
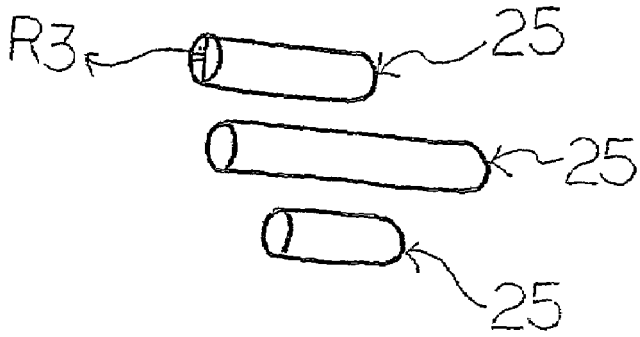
FIG. 5B shows an example set of plastic sticks.
Figure 6A:
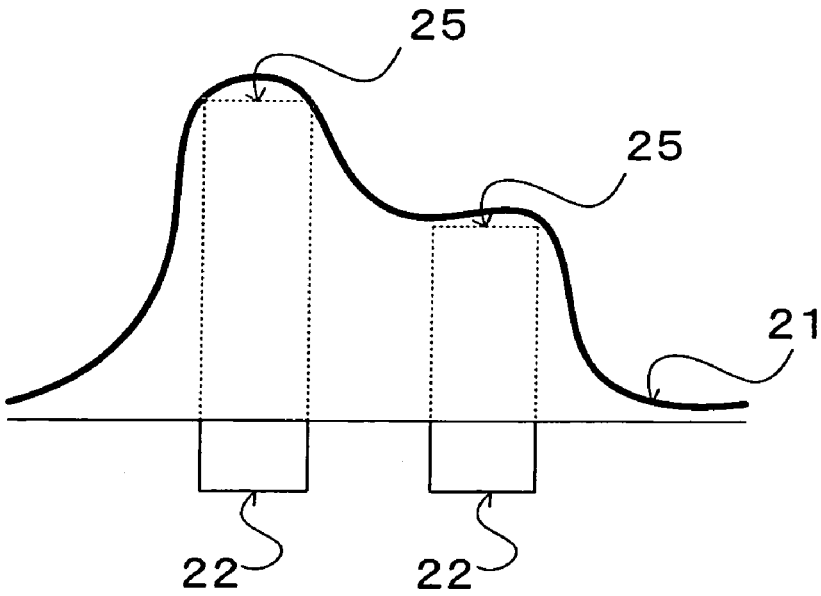
FIGS. 6A and 6B are cross-sectional views showing convex portions that are formed with a field cloth and plastic sticks.
Figure 6B:
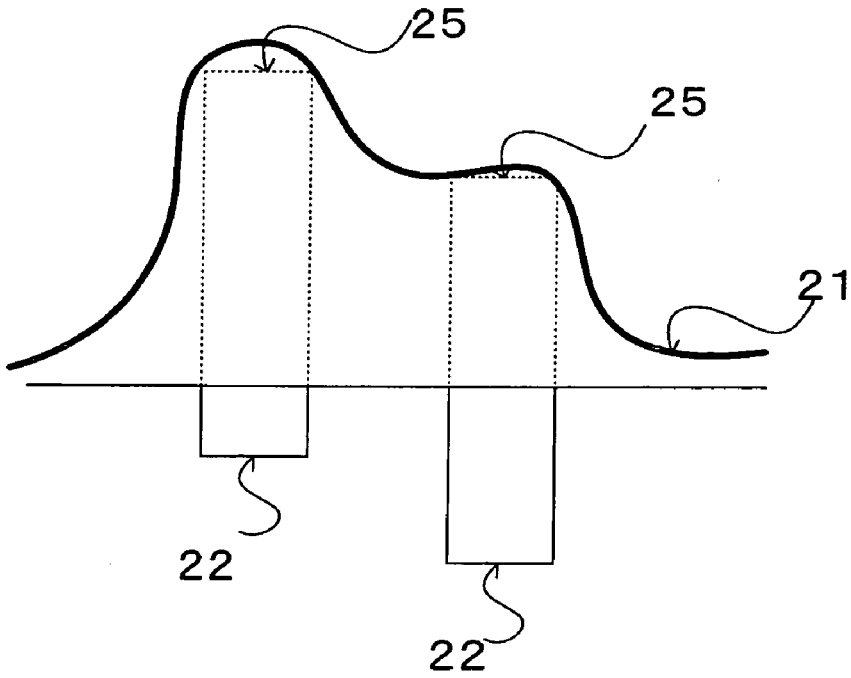

The plastic sticks 25 are made of plastic. As shown in FIG. 5B, thin, long cylinders with different lengths should preferably be prepared. Each of the plastic sticks 25 is inserted in a hole 22 in which a magnet 4 is not embedded, so that each of the plastic sticks 25 stands. As the standing plastic sticks 25 are covered with the field cloth 21, each of the plastic ticks 25 pushes up the field cloth 21 to form a mountain-like landform, as shown in FIG. 6A. The plastic sticks 25 with various lengths are provided on the mat 20, so as to form various landforms. If the plastic sticks 25 have uniform lengths, the depths of the holes 22 are made different from each other, as shown in FIG. 6B. In this manner, the same landforms as in the case with the plastic sticks with different lengths can be formed.

Figure 5C:
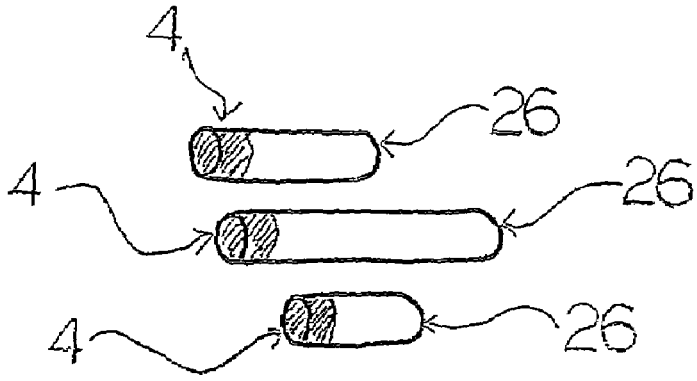
FIG. 5C shows an example set of magnet-attached plastic sticks.

Only with the plastic sticks 25, the combat vehicle models 1 can avoid the magnets 4 as landmines by running only on the convex portions. Therefore, the magnet-attached plastic sticks 26 having the magnets 4 attached to the top ends of the sticks 26 are prepared, as shown in FIG. 5C. The magnet-attached plastic sticks 26 have the same sizes and shapes as the plastic sticks 25, except that the magnets 4 are attached to the top ends. With the side with a magnet 4 facing upward, each magnet-attached plastic stick 26 is placed in the same manner as placing each plastic stick 25. After the plastic sticks 25 and 26 are covered with the field cloth 21, users cannot distinguish the convex portions formed by the magnet-attached plastic sticks 25 from the convex portions formed by the plastic sticks 25. Thus, a landform in which convex portions are not always safe can be formed.

In this embodiment, the protruding members are the plastic sticks 25 and the magnet-attached plastic sticks 26 that are made of plastic. However, the protruding members may be made of any other material, as long as the material does not react to the magnetic line sensor 5 and does not affect the magnetic field formed by the magnets 4. Also, it is possible to form accommodating portions for the plastic sticks 25 and the magnet-attached plastic sticks 26 besides the holes 22.

Figure 7A:
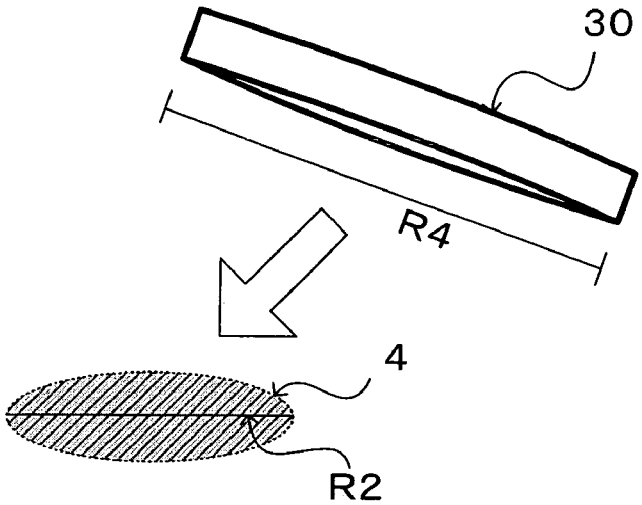
FIG. 7A shows a situation in which an iron sheet is placed on a magnet.
Figure 7B:
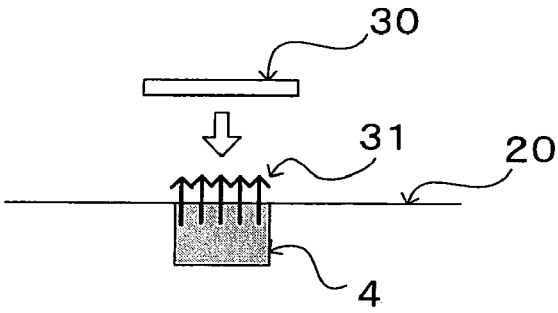
FIG. 7B shows regular magnetic field lines.
Figure 7C:
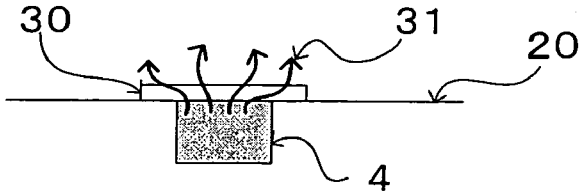
FIG. 7C shows magnetic field lines that are changed by placing the iron sheet onto the magnet.

Further in this embodiment, the post processing described below is performed after a magnet 4 is detected, so that a game development can be extended. Referring now to FIGS. 7A to 7C, the post processing is described.

After the combat vehicle model 1 detects a magnet 4 and a damage control operation is performed, a user can place an iron sheet 30 on the magnet 4 as the post processing, as shown in FIG. 7A. Here, the diameter R4 of the iron sheet 30 is greater than the diameter R2 of the magnet 4. With the iron sheet 30, the magnetic paths that are output from the magnet 4 can be widened, as shown in FIG. 7C. Also, the magnetic flux density becomes smaller than in the regular case illustrated in FIG. 7B. As the magnetic flux density becomes smaller than the detecting range, the magnetic line sensor 5 cannot detect the magnet 4 below the iron sheet 30, and the combat vehicle model 1 can safely run over the iron sheet 30. By placing the iron sheet 30 on the already detected magnet 4, the combat vehicle model 1 can be prevented from being damaged by the same magnet 4, as long as the iron sheet 30 covers the magnet 4.

The object to be placed on the magnet 4 is not necessarily an iron sheet, as long as the object has the characteristics that can reduce the magnetic flux density in the magnetic field formed by the magnet 4. However, a ferromagnetic body such as the iron sheet 30 that sticks to the magnet 4 is more preferable, because it steadies on the magnet 4.

By preparing magnets 4 with different magnetic intensities, it becomes possible to provide various detectable distances from the magnets 4. Accordingly, a wider variety of games can be enjoyed.

Figure 8:
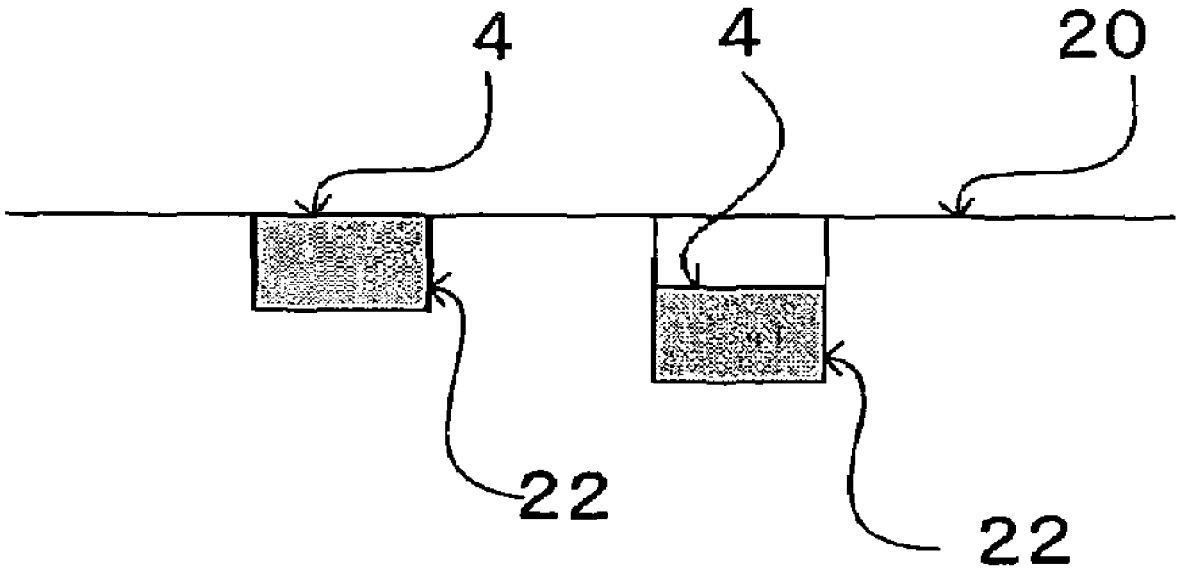
FIG. 8 shows a case where the holes have different depths.

Even with magnets 4 with the same magnetic intensities, the depths of the holes 22 are varied as shown in FIG. 8, so that the magnetic intensity of the magnet 4 embedded in the deeper hole 22 is made smaller. Thus, the same effects as when the magnets 4 with various magnetic intensities are prepared can be obtained.

Figure 9:
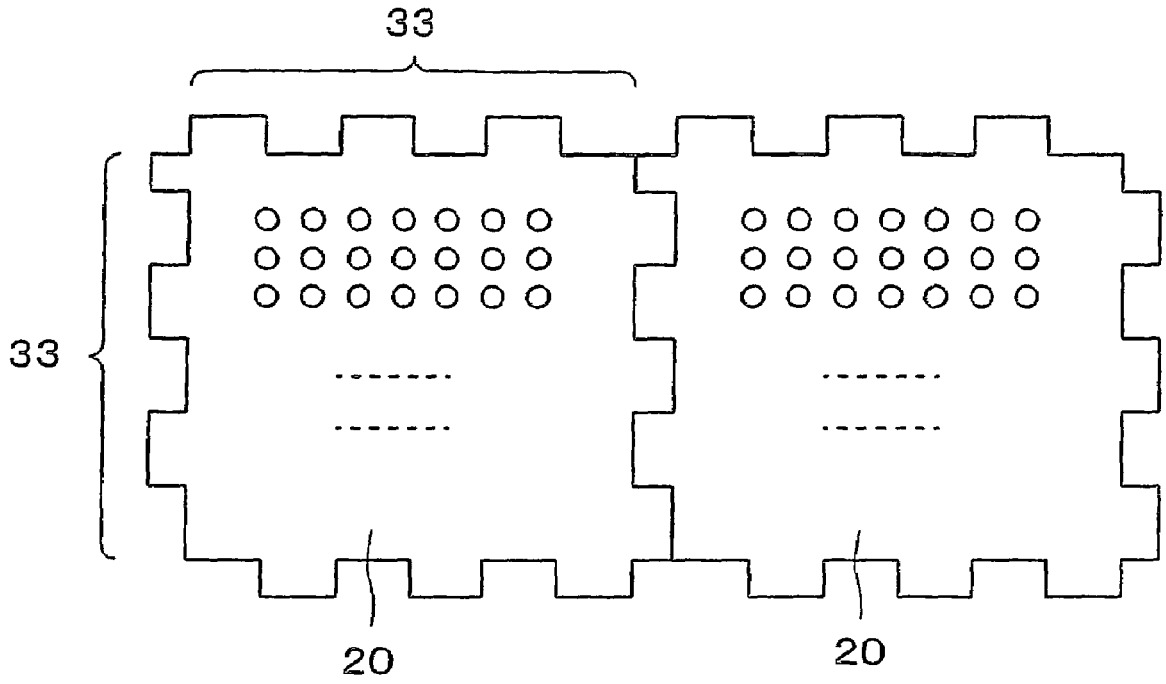
FIG. 9 shows fields joined through joining portions.

The field 3 may be joined with another field 3. For example, a hook or a belt as a joining portion may be provided to the mat 20, so that the mat 20 can be joined to another mat 20. Alternatively, irregular portions 33 may be formed on each of the peripheries surrounding the mat 20, so that the mat 20 can be engaged with another mat 20, as shown in FIG. 9. A user can form the field 3 as his/her territory on his/her mat 20 with the magnets 4, the plastic sticks 25, and the magnet-attached plastic sticks 26. The field 3 can be joined to another field 3 that is formed as the territory of an opponent. When a combat game is played on the joined fields 3, users can feel greater thrills, as the combat vehicle model 1 of each user has to run in the unknown territory of the opponent.

The above described embodiments are merely examples, and the present invention is not limited to those embodiments. Accordingly, various changes and modifications can be made to those embodiments.

Figure 10A:
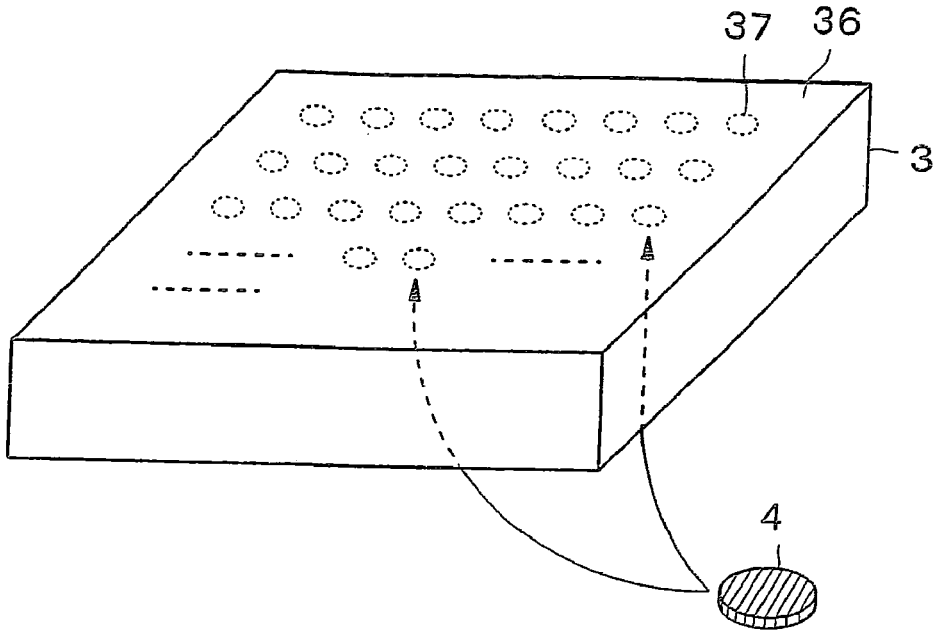
FIG. 10A shows an example case where magnets are placed on the reverse side of the surface of the field.

For example, it is possible to form the field 3 as a box-like structure the inside of which is hollow. FIG. 10A shows an example of such a structure. In this example, placement portions 37 in which the magnets 4 are to be embedded are formed on the reverse side of the surface 36 on which the movable body 1 is to run. The magnets 4 are attached to the reverse side of the surface 36, with the side of each magnet 4 to be sensed by the magnetic line sensor 5 facing upward with respect to the field 3.

Figure 10B:
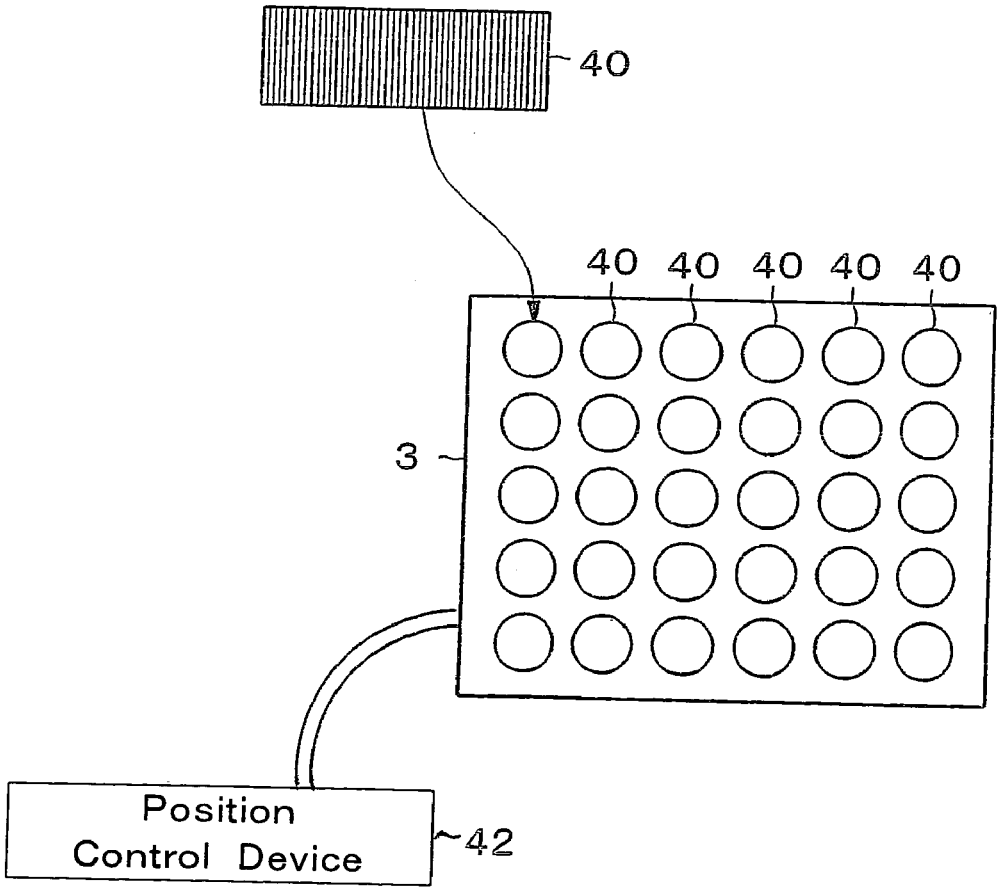
FIG. 10B shows a field in which electromagnets are used.

The detection objects 4 may be electromagnets. FIG. 10B shows an example of this embodiment. The field 3 is formed as a matrix structure in which coils 40 each having a magnetic body as its core are arranged in a matrix fashion. The coils 40 are electrically connected to one another, and the current flowing through each coil 40 is controlled by a position control device 42. As the coils 40 do not form a magnetic field in the situation where current is not applied to the coils 40, the magnetic line detector 5 cannot detect the coils 40. However, once current is applied to the coils 40 by the position control device 42, the coils 40 become electromagnets to form magnetic field lines in uniform directions. The electromagnets are detected by the magnetic line sensor 5. Each of the coils 40 has its own coordinates. A user can designate the coordinates of a coil 40 to be a detection object 4 to apply current only to the designated coordinates by the position control device 42. BY doing so, a detection object 4 can be formed at any located chosen by a user. A coil 35 to which current is to be applied can be not only designated by a user, but also randomly designated using a random number, regardless of the will of the user. Furthermore, coils 40 with different lengths may be prepared and be cloaked by the field cloth 21 in the above described manner, so that an undulating landform can be formed.

Further, the field 3 may be a structure in which electromagnets and magnets can be embedded at the same time.

In the above described embodiments, the detection objects 4 that generate magnetic field lines, and the magnetic line sensor 5 that senses magnetic field lines of uniform directions are used. However, the combination of the magnetic line sensor 5 and the detection objects 4 is not limited to the above, as long as the magnetic line sensor 5 can detect the detection objects 4 in a non-contact state. For example, invisible electromagnetic waves that do not cause crosstalk of control signals for remote control can be used. When the detection objects has such characteristics as to reflect the material to which the magnetic line sensor 5 reacts, even if the detection objects do not output the material from themselves, the magnetic line sensor 5 can detect the detection objects 4 by detecting the reflected material output from others.

As described so far, the present invention can provide a remote-control toy that gives a wider variety of games and provides more excitement through a means to affect the movable bodies besides a means to affect the movable bodies to each other.

The invention claimed is:

1. A remote-control toy comprising:

a controller for transmitting a control signal according to an operation by a user;

a movable body for being controlled based on the control signal from the controller; and a field member on which the moving body is allowed to move, wherein the movable body includes:

a detecting unit for reacting to a predetermined object to be detected and for outputting a detection signal; and a processing unit for performing a predetermined process in response to the output of the detection signal, wherein the field member comprises:

a mat;

a cover that cloaks a surface of the mat; and a plurality of placement portions, in which the predetermined object to be detected can be embredded, which are concave portions that open through the surface of the mat so that the position of the object to be detected can be arbitrarily changed.

2. The remote-control toy according to claim 1, wherein the predetermined object to be detected is a magnet.

3. The remote-control toy according to claim 1, further comprising a protruding member protruding from the surface of the mat is provided on the surface of the mat in such a manner that the position of the protruding member is adapted to change, and the protruding member also is adapted to be cloaked by the cover.

4. The remote-control toy according to claim 3, wherein the predetermined object to be detected is attached to the top end of the protruding member.

5. The remote-control toy according to claim 1, wherein the field member has a joining portion to be joined to another field member.

6. A field member on which a movable body is allowed to move, the movable body being controlled based on a control signal transmitted from a controller according to an operation by a user, the movable body includes a detecting unit for reacting to a predetermined object to be detected and for outputting a detection signal, and a processing unit for performing a predetermined process in response to the output of the detection signal, wherein the field member comprises:

a mat;

a cover that cloaks a surface of the mat; and a plurality of placement portions, in which the predetermined object to be detected can be embedded, which are concave portions that open through the surface of the mat so that the position of the object to be detected can be arbitrarily change changed.

7. The field member according to claim 6, wherein the field member has a joining portion to be joined to another field member.

* * * * *